US011211708B2

(12) United States Patent
Lo et al.

(10) Patent No.: US 11,211,708 B2
(45) Date of Patent: Dec. 28, 2021

(54) ANTENNA STRUCTURE

(71) Applicant: Quanta Computer Inc., Taoyuan (TW)

(72) Inventors: Chung-Hung Lo, Taoyuan (TW); Ying-Cong Deng, Taoyuan (TW); Kuan-Hsien Lee, Taoyuan (TW); Yi-Ling Tseng, Taoyuan (TW); Chung-Ting Hung, Taoyuan (TW); Chin-Lung Tsai, Taoyuan (TW)

(73) Assignee: QUANTA COMPUTER INC, Taoyuan (TW)

( * ) Notice: Subject to any disclaimer, the term of this patent is extended or adjusted under 35 U.S.C. 154(b) by 96 days.

(21) Appl. No.: 16/747,260

(22) Filed: Jan. 20, 2020

(65) Prior Publication Data

US 2021/0167501 A1 Jun. 3, 2021

(30) Foreign Application Priority Data

Nov. 28, 2019 (TW) ..... 108143305

(51) Int. Cl.
*H01Q 5/371* (2015.01)
*H01Q 1/48* (2006.01)
(Continued)

(52) U.S. Cl.
CPC ..... *H01Q 5/371* (2015.01); *H01Q 1/243* (2013.01); *H01Q 1/38* (2013.01); *H01Q 1/48* (2013.01); *H01Q 9/30* (2013.01)

(58) Field of Classification Search
CPC combination set(s) only.
See application file for complete search history.

(56) References Cited

U.S. PATENT DOCUMENTS 5,371,507 A * 12/1994 Kuroda ..... H01Q 9/0428 343/700 MS
5,386,214 A * 1/1995 Sugawara ..... H01Q 9/0457 343/700 MS (Continued)

FOREIGN PATENT DOCUMENTS

TW M422773 U 2/2012

OTHER PUBLICATIONS

Chinese language office action dated Jun. 19, 2020, issued in application No. TW 108143305.

*Primary Examiner* — Graham P Smith
*Assistant Examiner* — Jae K Kim
(74) *Attorney, Agent, or Firm* — McClure, Qualey & Rodack, LLP

(57) ABSTRACT

An antenna structure includes a ground plane, a first radiation element, a second radiation element, a third radiation element, and a dielectric substrate. The ground plane provides a ground voltage. The first radiation element includes a connection branch, a first branch, and a second branch. The connection branch has a feeding point. The first branch and the second branch substantially extend in opposite directions. The second radiation element is coupled to the feeding point. The second radiation element substantially surrounds a non-metal region, and is further coupled to the ground voltage. The third radiation element is coupled to the ground voltage. The third radiation element is adjacent to the first radiation element. The first radiation element, the second radiation element, and the third radiation element are all disposed on the dielectric substrate.

8 Claims, 2 Drawing Sheets

(51) Int. Cl.

| | |
|---|---|
| ***H01Q 1/38*** | (2006.01) |
| ***H01Q 9/30*** | (2006.01) |
| ***H01Q 1/24*** | (2006.01) |

(56) References Cited

U.S. PATENT DOCUMENTS

| | | | | |
|---|---|---|---|---|
| 6,353,443 | B1 * | 3/2002 | Ying | H01Q 1/243 715/702 |
| 8,456,365 | B2 * | 6/2013 | Pros | H01Q 9/42 343/700 MS |
| 2003/0174092 | A1 * | 9/2003 | Sullivan | H01Q 5/335 343/702 |
| 2005/0007283 | A1 * | 1/2005 | Jo | H01Q 1/243 343/702 |
| 2008/0180333 | A1 * | 7/2008 | Martiskainen | H01Q 1/243 343/722 |
| 2008/0238780 | A1 * | 10/2008 | Ponce De Leon | H01Q 9/0421 343/700 MS |
| 2009/0146906 | A1 * | 6/2009 | Anguera Pros | H01Q 1/243 343/906 |
| 2011/0122042 | A1 * | 5/2011 | Huang | H01Q 1/243 343/860 |
| 2020/0411986 | A1 * | 12/2020 | Cooper | H01Q 9/0421 |

* cited by examiner

ANTENNA STRUCTURE

CROSS REFERENCE TO RELATED APPLICATIONS

This application claims priority of Taiwan Patent Application No. 108143305 filed on Nov. 28, 2019, the entirety of which is incorporated by reference herein.

BACKGROUND OF THE INVENTION

Field of the Invention

The disclosure generally relates to an antenna structure, and more particularly, it relates to a wideband antenna structure.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz, Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

SUMMARY OF THE INVENTION

In an exemplary embodiment, the disclosure is directed to an antenna structure that includes a ground plane, a first radiation element, a second radiation element, a third radiation element, and a dielectric substrate. The ground plane provides a ground voltage. The first radiation element includes a connection branch, a first branch, and a second branch. The connection branch has a feeding point. The first branch and the second branch substantially extend in opposite directions. The second radiation element is coupled to the feeding point. The second radiation element substantially surrounds a non-metal region, and is further coupled to the ground voltage. The third radiation element is coupled to the ground voltage. The third radiation element is adjacent to the first radiation element. The first radiation element, the second radiation element, and the third radiation element all disposed on the dielectric substrate.

In some embodiments, each of the connection branch, the first branch, and the second branch substantially has a straight-line shape, so that the first radiation element is substantially T-shaped.

In some embodiments, the second radiation element substantially forms a loop structure with a notch.

In some embodiments, the non-metal region is substantially L-shaped.

In some embodiments, the third radiation element substantially has a straight-line shape and is substantially parallel to the connection branch.

In some embodiments, the antenna structure covers a first frequency band, a second frequency band, and a third frequency band. The first frequency band is substantially at 1575 MHz. The second frequency band is from 2400 MHz to 2500 MHz. The third frequency band is from 5150 MHz to 5850 MHz.

In some embodiments, a coupling gap is formed between the third radiation element and the first radiation element, such that the third radiation element is excited by the first radiation element using a coupling mechanism.

In some embodiments, the total length of the connection branch and the second branch is substantially equal to 0.25 wavelength of the second frequency band.

In some embodiments, the length of the second radiation element is substantially equal to 0.5 wavelength of the third frequency band.

In some embodiments, the length of the third radiation element is shorter than or equal to 0.125 wavelength of the first frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1:
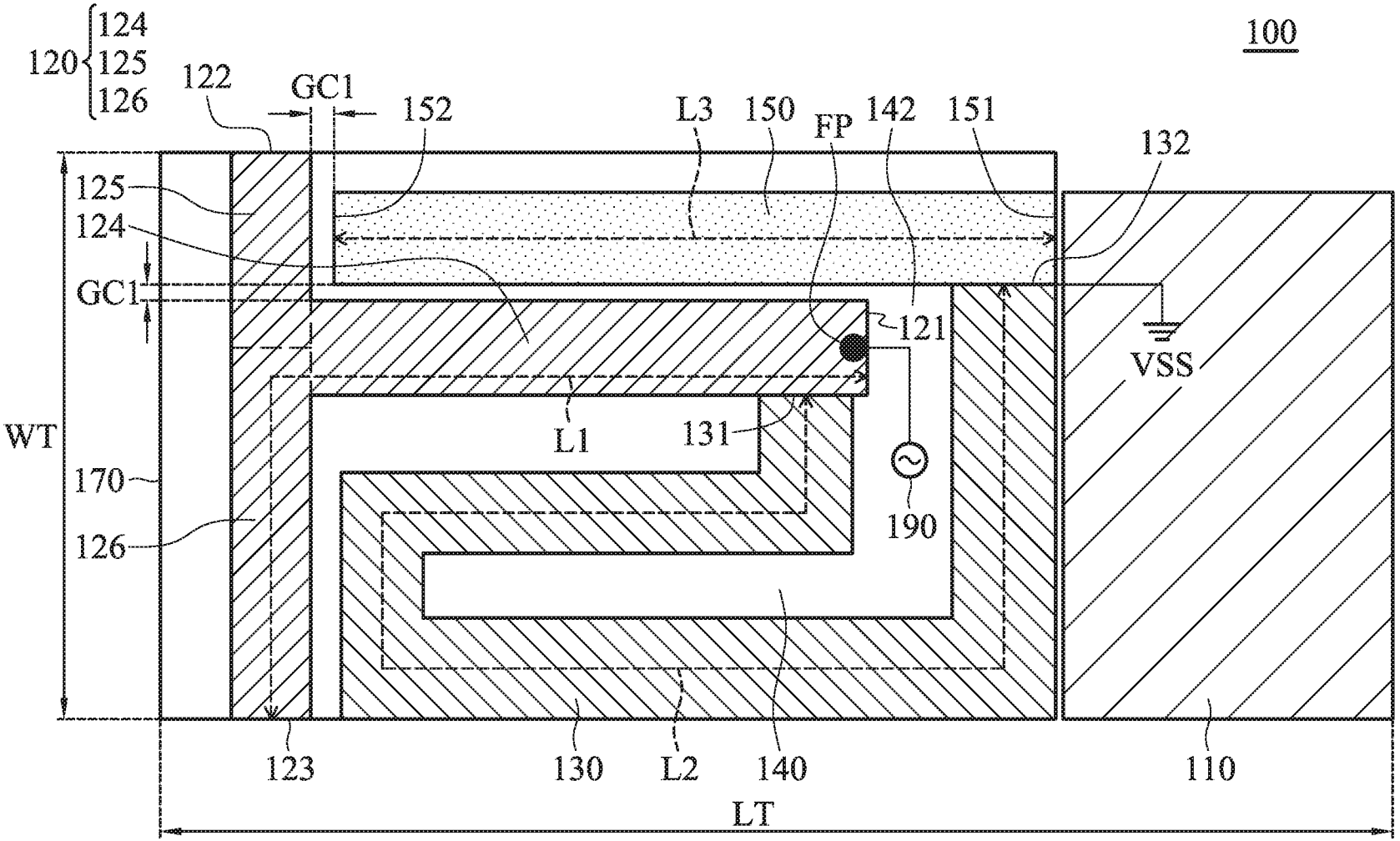
FIG. 1 is a top view of an antenna structure according to an embodiment of the invention.

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve be proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

FIG. 1 is a top view of an antenna structure 100 according to an embodiment of the invention. The antenna structure 100 may be applied to a mobile device, such as a smart phone, a tablet computer, or a notebook computer. As shown in FIG. 1, the antenna structure 100 at least includes a ground plane 110, a first radiation element 120, a second radiation element 130, a third radiation element 150, and a dielectric substrate 170. The ground plane 110, the first radiation element 120, the second radiation element 130, and the third radiation element 150 may all be made of metal materials, such as silver, copper, aluminum, iron, or their alloys.

The dielectric substrate 170 may be an FR4 (Flame Retardant 4) substrate, a PCB (Printed Circuit Board), or an FCB (Flexible Circuit Board). The first radiation element 120, the second radiation element 130, and the third radiation element 150 are all disposed on the dielectric substrate 170, and therefore the antenna structure 100 may be substantially planar.

The ground plane 110 may substantially have a rectangular shape. For example, the ground plane 110 may be a ground copper foil, which may be further coupled to a system ground plane (not shown) and can provide a ground voltage VSS. In some embodiments, the ground plane 110 is adjacent to an edge of the dielectric substrate 170. In alternative embodiments, the ground plane 110 partially extends onto the dielectric substrate 170. It should be noted that the term "adjacent" or "close" over the disclosure means that the distance (spacing) between two corresponding elements is smaller than a predetermined distance (e.g., 10 mm or shorter) or means that the two corresponding elements are touching each other directly (i.e., the aforementioned distance/spacing therebetween is reduced to 0).

The first radiation element 120 may substantially have a T-shape. Specifically, the first radiation element 120 has a first end 121, a second end 122, and a third end 123. The first radiation element 120 includes a connection branch 124, a first branch 125, and a second branch 126 which are coupled to each other. Each of the second end 122 and the third end 123 of the first radiation element 120 is an open end. The connection branch 124 is adjacent to the first end 121 of the first radiation element 120. The first branch 125 is adjacent to the second end 122 of the first radiation element 120. The second branch 126 is adjacent to the third end 123 of the first radiation element 120. For example, each of the connection branch 124, the first branch 125, and the second branch 126 may substantially have a straight-line shape. Both the first branch 125 and the second branch 126 are perpendicular to the connection branch 124. The second end 122 of the first branch 125 and the third end 123 of the second branch 126 substantially extend in opposite directions. The length of the second branch 126 may be 2 or 3 times the length of the first branch 125. A feeding point FP is positioned at the first end 121 of the connection branch 124. The feeding point FP may be further coupled to a signal source 190, such as an RF (Radio Frequency) module, for exciting the antenna structure 100.

The second radiation element 130 may have a meandering shape, so as to substantially surround a non-metal region 140. For example, the non-metal region 140 may substantially have an L-shape, but it is not limited thereto. Specifically, the second radiation element 130 has a first end 131 and a second end 132. The first end 131 of the second radiation element 130 is coupled to the feeding point FP and the first end 121 of the first radiation element 120. The second end 132 of the second radiation element 130 is coupled to the ground voltage VSS. In some embodiments, the second radiation element 130 substantially forms a loop structure with a notch 142, and the notch 142 is connected to the non-metal region 140.

The third radiation element 150 may substantially have a straight-line shape, which may be completely separate from the first radiation element 120, and substantially parallel to the connection branch 124 of the first radiation element 120. Specifically, the third radiation element 150 has a first end 151 and a second end 152. The first end 151 of the third radiation element 150 is coupled to the ground voltage VSS and the second end 132 of the second radiation element 130. The second end 152 of the third radiation element 150 is an open end, which is adjacent to the connection branch 124 and the first branch 125 of the first radiation element 120.

Figure 2:
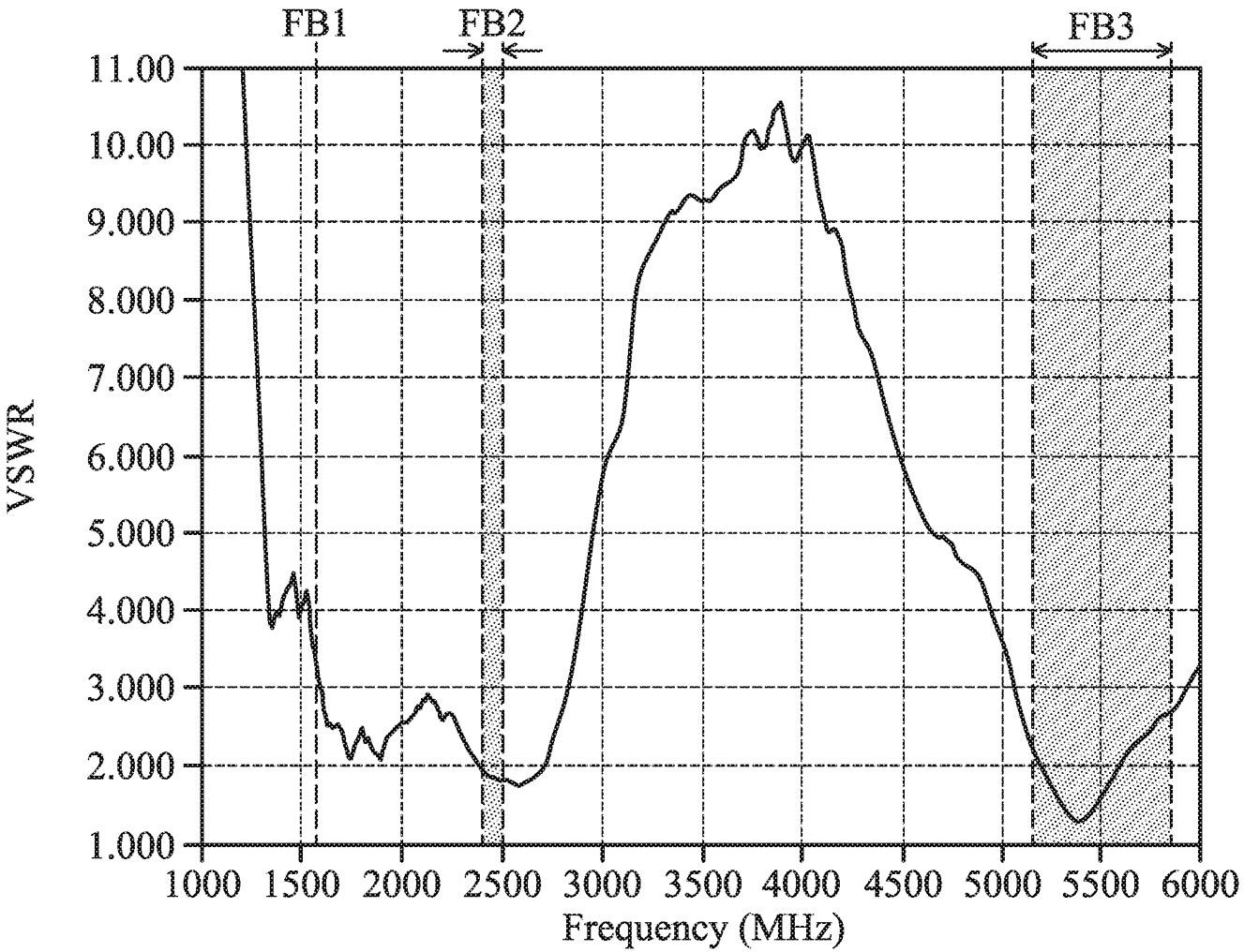
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 2, the antenna structure 100 can cover a first frequency band FB1, a second frequency band FB2, and a third frequency band FB3. For example, the first frequency band FB1 may be at or around 1575 MHz, the second frequency band FB2 may be from 2400 MHz to 2500 MHz, and the third frequency band FB3 may be from 5150 MHz to 5850 MHz. Accordingly, the antenna structure 100 can support at least the wideband operation of GPS (Global Positioning System) and WLAN (Wireless Local Area Networks) 2.4 GHz/5 GHz.

In some embodiments, the operation principles of the antenna structure 100 are described as follows. A coupling gap GC1 is formed between the third radiation element 150 and the first radiation element 120, therefore the third radiation element 150 is excited by the first radiation element 120 using a coupling mechanism, so as to generate the first frequency band FB1. The connection branch 124 and the second branch 126 of the first radiation element 120 are excited to generate the second frequency band FB2. The first branch 125 of the first radiation element 120 is configured to fine-tune the impedance matching of the second frequency band FB2, and to increase the operation bandwidth of the second frequency band FB2. In addition, the second radiation element 130 is excited to generate the third frequency band FB3 independently. It should be noted that the third radiation element 150 provides an inductance, and the coupling gap GC1 between the third radiation element 150 and the first radiation element 120 contributes to a capacitance, which compensates for the aforementioned inductance. With such a design, the third radiation element 150 can use a relatively-short resonant length to cover the relatively-low first frequency band FB1, and therefore the total size of the antenna structure 100 is significantly reduced.

In some embodiments, the element sizes of the antenna structure 100 are described as follows. The total length L1 of the connection branch 124 and the second branch 126 of the first radiation element 120 (i.e., the total length L1 from the first end 121 through the intersection point to the third end 123) may be substantially equal to 0.25 wavelength (λ/4) of the second frequency band FB2. The length L2 of the second radiation element 130 (i.e., the length L2 from the first end 131 to the second end 132) may be substantially equal to 0.5 wavelength (λ/2) of the third frequency band FB3. The length L3 of the third radiation element 150 (i.e., the length L3 from the first end 151 to the second end 152) may be substantially shorter than or equal to 0.125 wavelength (λ/8) of the first frequency band FB1. The width of the coupling gap 1 may be from 0.1 mm to 1 mm, such as 0.2 min. The total length LT of the antenna structure 100 may be about 40 mm. The total width WT of the antenna structure 100 may be about 15 mm. The above ranges of element sizes are calculated and obtained according to many experiment results, and they help to optimize the operation bandwidth and impedance matching of the antenna structure 100.

The invention proposes a novel antenna structure, which can use a coupling mechanism to minimize the antenna size and cover multiband operations. In comparison to the conventional design, the invention has at least the advantages of small size, wide bandwidth, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-2. The invention may merely include any one or more features of any one or more embodiments of FIGS. 1-2. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a ground plane, providing a ground voltage;

a first radiation element, comprising a connection branch, a first branch, and a second branch, wherein the connection branch has a feeding point, and the first branch and the second branch substantially extend in opposite directions;

a second radiation element, coupled to the feeding point, wherein the second radiation element substantially surrounds a non-metal region and is further coupled to the ground voltage;

a third radiation element, coupled to the ground voltage, wherein the third radiation element is adjacent to the first radiation element; and a dielectric substrate, wherein the first radiation element, the second radiation element, and the third radiation element are disposed on the dielectric substrate;

wherein the antenna structure covers a first frequency band, a second frequency band, and a third frequency band, the first frequency band is substantially at 1575 MHz, the second frequency band is from 2400 MHz to 2500 MHz, and the third frequency band is from 5150 MHz to 5850 MHz;

wherein a total length of the connection branch and the second branch is substantially equal to 0.25 wavelength of the second frequency band.

2. The antenna structure as claimed in claim 1, wherein each of the connection branch, the first branch, and the second branch substantially has a straight-line shape, such that the first radiation element substantially has a T-shape.

3. The antenna structure as claimed in claim 1, wherein the second radiation element substantially forms a loop structure with a notch.

4. The antenna structure as claimed in claim 1, wherein the non-metal region substantially has an L-shape.

5. The antenna structure as claimed in claim 1, wherein the third radiation element substantially has a straight-line shape and is substantially parallel to the connection branch.

6. The antenna structure as claimed in claim 1, wherein a coupling gap is formed between the third radiation element and the first radiation element, such that the third radiation element is excited by the first radiation element using a coupling mechanism.

7. The antenna structure as claimed in claim 1, wherein a length of the second radiation element is substantially equal to 0.5 wavelength of the third frequency band.

8. The antenna structure as claimed in claim 1, wherein a length of the third radiation element is shorter than or equal to 0.125 wavelength of the first frequency band.

* * * * *